US005666984A

United States Patent [19]

Horikawa et al.

[11] Patent Number: 5,666,984

[45] Date of Patent: Sep. 16, 1997

[54] METHOD AND APPARATUS FOR DECONTAMINATING SUBSTANCES CONTAMINATED WITH RADIOACTIVITY

[75] Inventors: Kenji Horikawa, Kohshoku; Hiroshi Obinata, Nagano; Kazuo Omata, Iruma; Toshihiko Sato, Hohya; Yoshihiko Nakajima, Toguramachi; Seigo Ichikawa, Kohshoku, all of Japan

[73] Assignee: Morikawa Industries Corporation, Kohshoku, Japan

[21] Appl. No.: 635,683

[22] Filed: Apr. 22, 1996

Related U.S. Application Data

[62] Division of Ser. No. 412,310, Mar. 29, 1995, Pat. No. 5,570,468.

[30] Foreign Application Priority Data

Sep. 13, 1994 [JP] Japan ..... 6-218756

[51] Int. Cl.[6] ..... B08B 3/06

[52] U.S. Cl. ..... 134/95.2; 134/95.3; 134/111; 134/102.3; 134/104.4; 134/157; 134/159; 451/85

[58] Field of Search ..... 134/111, 102.1, 134/102.3, 95.3, 99.1, 104.4, 135, 140, 157, 159; 68/18 F; 451/39, 75, 85

[56] References Cited

U.S. PATENT DOCUMENTS

| | | | |
|---|---|---|---|
| 4,443,269 | 4/1984 | Capella . | |
| 4,601,181 | 7/1986 | Privat | 68/18 F |
| 4,630,625 | 12/1986 | Capella et al. | 134/111 |
| 4,724,853 | 2/1988 | Hirose . | |
| 4,771,579 | 9/1988 | Giese . | |
| 4,781,041 | 11/1988 | Fowler | 68/18 F |
| 4,909,050 | 3/1990 | Sewter et al. | 68/18 F |
| 5,126,077 | 6/1992 | Morikawa et al. . | |
| 5,266,494 | 11/1993 | Lahoda et al. . | |
| 5,492,139 | 2/1996 | Lashmett et al. | 134/111 |
| 5,503,591 | 4/1996 | Morikawa et al. . | |

*Primary Examiner*—Frankie L. Stinson

*Attorney, Agent, or Firm*—Armstrong, Westerman, Hattori, McLeland & Naughton

[57] ABSTRACT

A method and apparatus for decontaminating a substance contaminated with radioactivity, in particular, shot blasting grit contaminating with radioactivity. The method comprises: contaminated substance washing the substance to be decontaminated with chelate liquid; draining the chelate liquid; raising the temperature of the substance to a level not lower than the boiling point of a solvent by means of hot air; supplying the solvent to the substance and rapid by vaporizing the solvent; removing the remaining chelate fluid liquid by the force of the vaporization and draining and drying the substance. The apparatus comprises: a decontamination vessel rotatable in a main vessel which has a spray device, the decontamination vessel having a multitude of pores in its outer periphery; a solvent supply device communicating with the spray device and a solvent filtering device communicating with the main vessel, provided in a way to allow circulation of liquid; a purifying device for obtaining a rinse solvent; a chelate liquid supply device in communication with the spray device; a chelate liquid filtering device connected with the main vessel and communicating with the chelate supply device; an electrolytic processing device for regenerating the chelate liquid and communicating with the chelate liquid supply device; and a hot air supply device communicating with the main vessel.

5 Claims, 4 Drawing Sheets

METHOD AND APPARATUS FOR DECONTAMINATING SUBSTANCES CONTAMINATED WITH RADIOACTIVITY

This is a division of application Ser. No. 08/412,310 filed Mar. 29, 1995 now U.S. Pat. No. 5,570,468.

BACKGROUND OF THE INVENTION

1. Field of the Invention

This invention relates to a method and an apparatus for decontaminating substances contaminated with radioactivity that are to be used in a nuclear power station or the like for the purpose of decontaminating such contaminated substances.

2. Description of the Prior Art

Heretofore, in a nuclear power station or the like, various parts contaminated with radioactivity are produced in the power generating equipment, the attendant equipment thereof, etc., as a result of a long-term operation.

To decontaminate such parts, a shot blasting method is generally employed. As a result, a great amount of shot blasting grit contaminated with radioactivity is produced. The amount of such contaminated grit, which is usually stored in metal drums, is enormous, so that a vast storage place is required. However, an attempt to expand the storage place will meet with objections from the inhabitants of the area, thereby causing a social problem.

It is accordingly an object of the present invention to provide a method and an apparatus for decontaminating substances contaminated with radioactivity which help to decontaminate grit contaminated with radioactivity to thereby make it possible to reduce the requisite area for storing the grit.

While in this invention the object of decontamination is mainly shot blasting grit contaminated with radioactivity, as stated above, the method and the apparatus of this invention are not restricted to the decontamination of such grit, but are also applicable to the decontamination of other substances contaminated with radioactivity.

In such a decontaminating apparatus, a problem generally experienced is the necessity to move the contaminated substance from one place to another for each decontamination process. That is, the contaminated substance is first decontaminated by using a liquid, rinsed in the same liquid, and then dried. Then, the substance is decontaminated with another liquid, rinsed in the same liquid, dried, and so on. Thus, the contaminated substance must be moved from one decontaminating apparatus to another. As a result, a great space is required for installing these apparatuses. Further, it is necessary to provide a step and a device for performing the bothersome operation of moving the substance from one decontaminating apparatus to another and for mechanically and reliably grasping and releasing the substance each time it is moved.

It is an object of this invention to provide a method and an apparatus for decontaminating substances contaminated with radioactivity which require no such large space, do not necessitate any movement of the contaminated substance for each decontaminating step, and do not require any complicated apparatus for mechanically grasping and releasing the contaminated substance, whereby all of the decontamination processes can be performed in a single apparatus. In some cases, for convenience sake, a plurality of apparatuses according to the present invention may be provided, the contaminated substance being moved between these apparatuses. Such arrangement is also included in the scope of this invention for the purpose of achieving an improvement in operational efficiency, without any difference to the fact that a single apparatus can perform all the decontaminating processes.

Another object of this invention is to provide a method and an apparatus for decontaminating substances contaminated with radioactivity which make it possible to decontaminate the contaminated substances effectively and to a sufficient degree.

BRIEF SUMMARY OF THE INVENTION

To achieve the above objects, this invention provides a method for decontaminating substances contaminated with radioactivity, comprising the steps of: decontaminating a substance contaminated with radioactivity by using a chelate liquid, removing the chelate liquid from the contaminated substance, drying and heating the contaminated substance by hot air at a temperature not lower than the boiling point of a solvent, adding the above-mentioned solvent to the contaminated substance to rapidly vaporize the solvent to thereby separate the remaining chelate liquid from the contaminated substance, and removing the thus separated chelate liquid from the contaminated substance together with the solvent.

There is also provided an aspect of the method for decontaminating substances contaminated with radioactivity, wherein methylene chloride is used as a solvent.

There is further provided another aspect of the method for decontaminating substances contaminated with radioactivity, wherein the substance contaminated with radioactivity is shot blasting grit.

In accordance with this method, constructed as described above, the remaining chelate liquid adhering to the contaminated substance and containing contaminated metal ions is separated from the contaminated substance by the rapid vaporization of the solvent, and then drained along with the solvent subsequently fed. Thus, the remaining chelate can be removed effectively to thereby effect decontamination. Further, the draining of the solvent immediately results in the substance being brought to a dried state, so that there is no need to perform the bothersome operation of removing the chelate liquid by drying. This can be executed very effectively when the solvent is methylene chloride. Further, when the contaminated substance is shot blasting grit, which consists of fine particles, it is possible to effectively perform the difficult separation and removal of the remaining and adhering chelate liquid, bringing the grit in a dried state.

This invention also provides an apparatus for decontaminating substances contaminated with radioactivity, comprising: a washing device including a spray device for ejecting liquid, a solvent filtering device, and a chelate liquid filtering device; a solvent supply device communicating with the spray device and the solvent filtering device and provided in sucha way as to allow circulation of liquid; a rinse solvent supply device connected to the solvent supply device through the intermediation of a solvent purifying device and communicating with the spray device; a chelate liquid supply device provided in such a way as to allow circulation successively through the spray device, and the chelate liquid filtering device; an electrolytic processing device communicating with the chelate liquid supply device and adapted to electrolyze the chelate liquid; a precipitation device for supplying a precipitant to the chelate liquid which has lost its chelating property by being electrolyzed by the electrolytic device, to thereby form flocs in the liquid; a filtering device communicating with an ion exchange device and adapted to filter the flocs; a chelating agent supply device communicating with the ion exchange device and adapted to supply chelating agent to water; and a hot air supply device and a gas recovery device which communicate with the washing device.

There is also provided an aspect of the apparatus for decontaminating substances contaminated with radioactivity, wherein the washing device comprises a main vessel provided to a frame and having an opening and a lid; a decontamination vessel rotatably provided in the main vessel and having a large number of pores in its outer periphery, an opening and an opening/closing lid; and a driving device connected with the decontaminating vessel and adapted to rotate the decontaminating vessel.

There is provided another aspect of the apparatus for decontaminating substances contaminated with radioactivity, wherein the pores have a width or size that is smaller than that of the shot blasting grit, so that the shot blasting grit cannot pass therethrough.

There is provided still another aspect of the apparatus for decontaminating substances contaminated with radioactivity, wherein the decontamination vessel has a polishing-cleaning material combined with the decontamination vessel.

There is provided yet another aspect of the apparatus for decontaminating substances contaminated with radioactivity, wherein the decontamination vessel is detachably formed with respect to the main vessel, and a plurality of decontamination vessels and a plurality of main vessels are formed.

Next, the operation of the apparatus will be described. In the apparatus of this invention, constructed as described above, a single apparatus can perform all of the following processes: decontamination using a solvent and decontamination using a chelate liquid; rinsing using a solvent, and separation of the remaining chelate liquid rapidly resulting from the rinsing; drying of a contaminated substance, and so on.

Further, the chelate liquid can be reproduced and recycled through the steps of: electrolysis in a electrolytic device, addition of a precipitant in a precipitation device to form and precipitate flocs, filtration, processing in an ion exchange device to make clean water, and supplying thereto of a chelating agent from a chelating agent supply device. Also the pores of the decontamination vessel having a size or width that is smaller than that of the grit enable the grit to be effectively decontaminated. Further, since the decontamination vessel has a polishing-cleaning material, decontamination is performed effectively by joint use of polishing and cleaning during the so-called running-liquid washing using the solvent and the chelate liquid. Further, in an aspect where the decontamination vessel is detachably formed with respect to the main vessel, and a plurality of main vessels and a plurarity of decontamination vessels are formed, a time-consuming process and a non-time consuming process can be conducted separately, thereby achieving an improvement in operational efficiency.

DESCRIPTION OF THE PREFERRED EMBODIMENT

Figure 1:
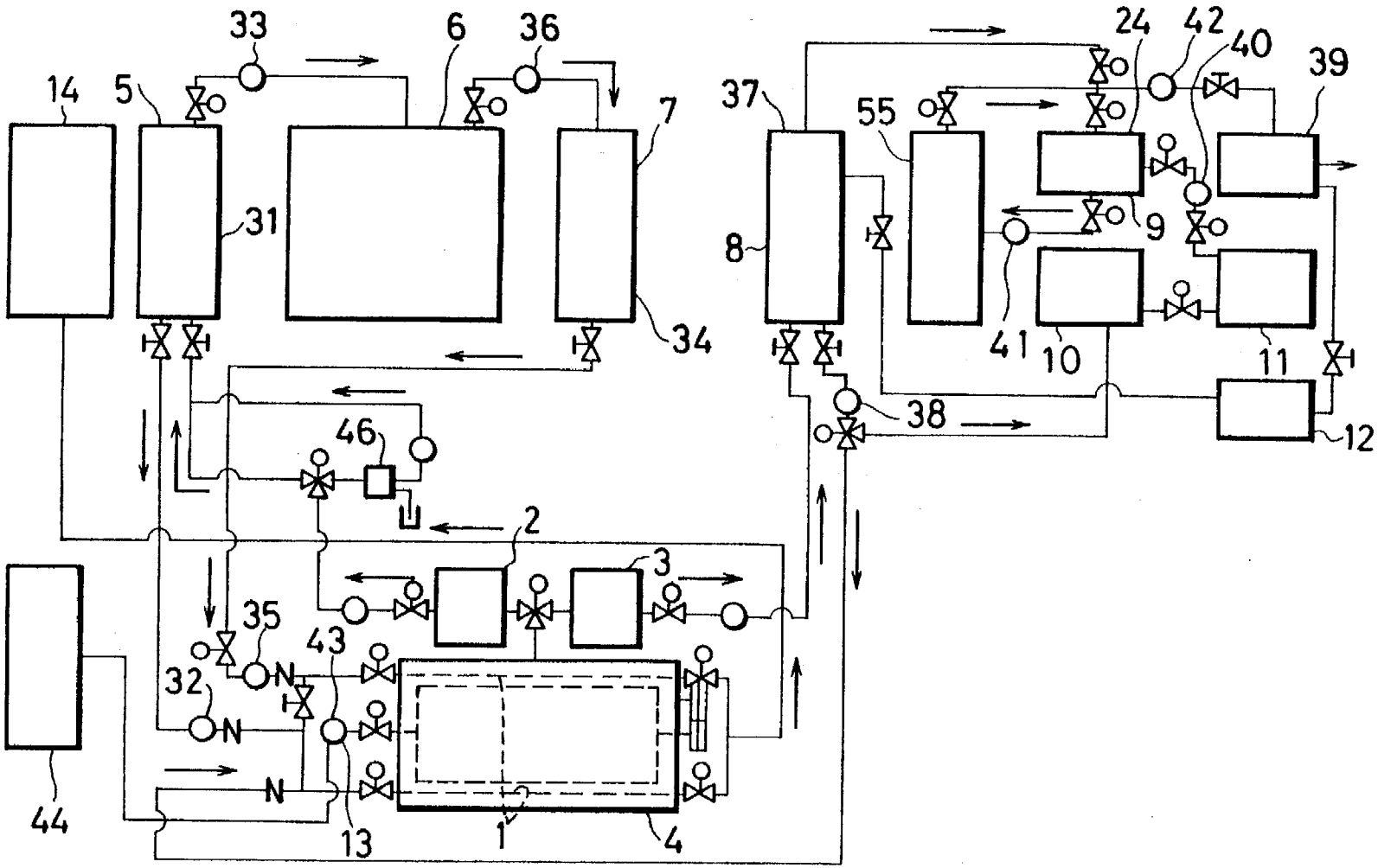
FIG. 1 is a block diagram schematically showing an apparatus for decontaminating a substance contaminated with radioactivity according to an embodiment of this invention.
Figure 3:
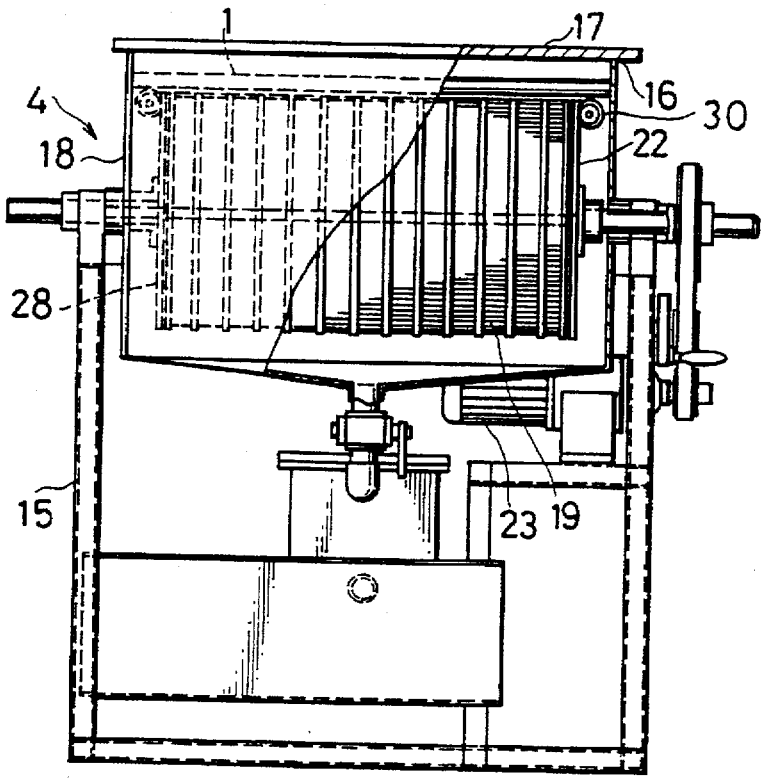
FIG. 3 is a front view of a washing device of the decontaminating apparatus.
Figure 4:
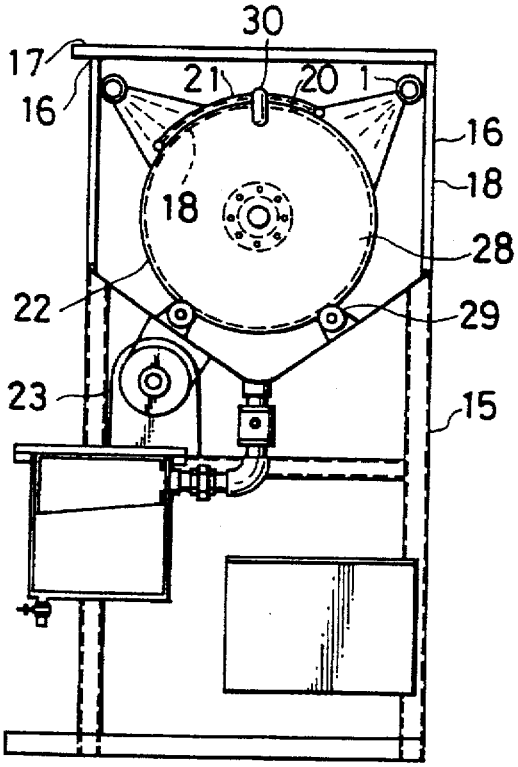
FIG. 4 is a side view of the washing device of the decontaminating apparatus.
Figure 5:
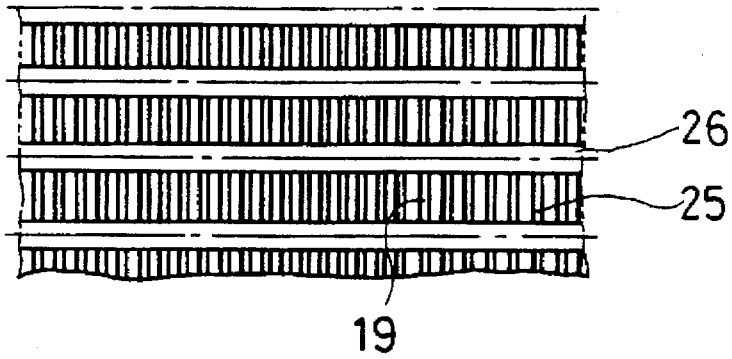
FIG. 5 is a plan view showing a part of the washing device of the decontaminating apparatus.
Figure 6:
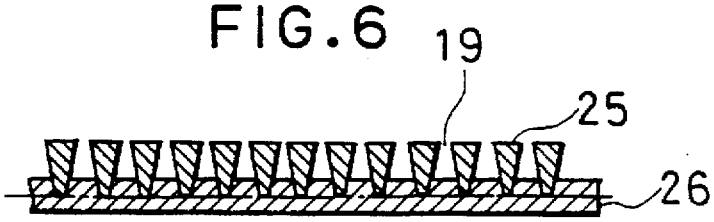
FIG. 6 is a side view showing a part of the washing device of the decontaminating apparatus.

In FIG. 1, numeral 4 indicates a washing device, which includes a spray device 1 for ejecting liquid, a solvent filtering device 2, and a chelate liquid filtering device 3. The spray device 1, which is not shown in detail in the drawing, comprises a pipe provided with a multitude of nozzles. As shown in FIGS. 3 and 4, the washing device 4 comprises a frame 15, to which is provided a main vessel 18 having an opening 16 and a lid 17. A decontamination vessel 22 is rotatably arranged in the main vessel 18. Numeral 19 indicates a multitude of pores formed in the decontamination vessel 22. As shown in FIGS. 5 and 6, the decontamination vessel 22 is formed as a cylindrical body formed of wedge wires 25, which are supported by support bars 26 such that slits are defined between these wedge tires. These slits constitute the pores 19. Thus, in this invention, the term "pores" includes "slits". Numeral 28 indicates an end plate. Numeral 20 indicates an opening, and numeral 21 indicates an opening/closing cover having a multitude of pores 19 like the decontamination vessel 22.

The pores 19 have a width or size that is smaller than that of the shot blasting grit. Referring to FIG. 4, numeral 29 indicates rotating members, which consist, for example, of racing rollers. These rotating members support decontamination vessel 22. The decontamination vessel 22 is driven by a driving device 23. Further, the decontamination vessel 22 has a suspension lug 30, by means of which the decontamination vessel 22 can be suspended from an overhead travelling hoist (not shown) so that it can be moved to another main vessel 18 (not shown).

Referring to FIG. 1, numeral 5 indicates a solvent supply device, which comprises a solvent vessel 31 containing, for example, methylene chloride, and a first pump 32. The solvent is circulated by way of the spray device 1 and the solvent filtering device 2.

Numeral 6 indicates a solvent purifying device which purifies the solvent by heating, vaporizing, and cooling. The solvent purifying device 6 has a second pump 33 and is connected to a rinse solvent supply device 7 comprising a rinse solvent vessel 34 for rinsing and a third pump 35. Numeral 36 indicates a fourth pump. Numeral 8 indicates a chelate liquid supply device, which circulates the chelate liquid by way of a chelate liquid vessel 37, a fifth pump 38, the spray device 1, and the chelate liquid filtering device 3, and, then, back to the chelate liquid vessel 37. Numeral 10 indicates an electrolytic processing device for electrolyzing the chelate liquid which contains metal ions. In the electrolytic processing device 10, the chelate liquid is electrolyzed to thereby lose its chelating property.

In a precipitating device 11, a precipitant is added to the chelate liquid which has lost its chelating property, thereby generating flocs in the liuqid. These flocs are removed by filtering the liquid by a filtering device 9. Examples of the precipitant include sodium hydroxide, aqueous ammonia, potassium hexacyanoferrate, and high-molecular coagulant.

The water generated in the filtering device 9 is supplied to an ion exchange device 39, where it becomes clean water. A chelating agent is added to the clean water in a chelating agent supply device 12 and the resulting solution is supplied to the chelate liquid vessel 37 again.

Numerals 38, 40, 41 and 42 indicate fifth, sixth, seventh and eighth pumps, respectively. The clean water generated in the ion exchange device 39 may be discharged.

Figure 2:
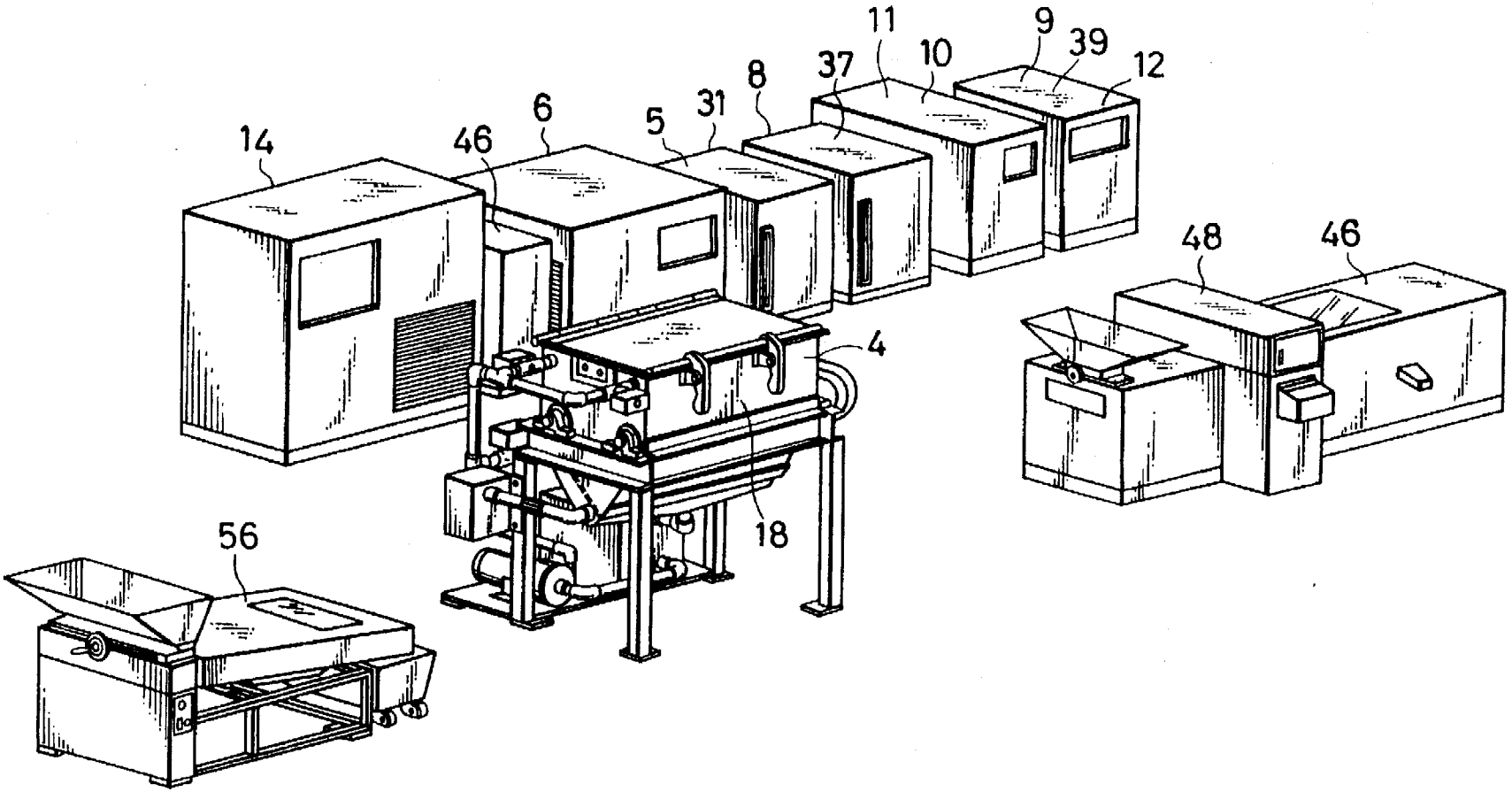
FIG. 2 is a perspective view schematically showing an apparatus for decontaminating a substance contaminated with radioactivity and an apparatus for inspecting a substance contained with radioactivity.

In FIG. 1, numeral 55 indicates a storage vessel, and, in FIG. 2, numeral 56 indicates an oscillating sieve for removing foreign matter from the grit.

Figure 7:
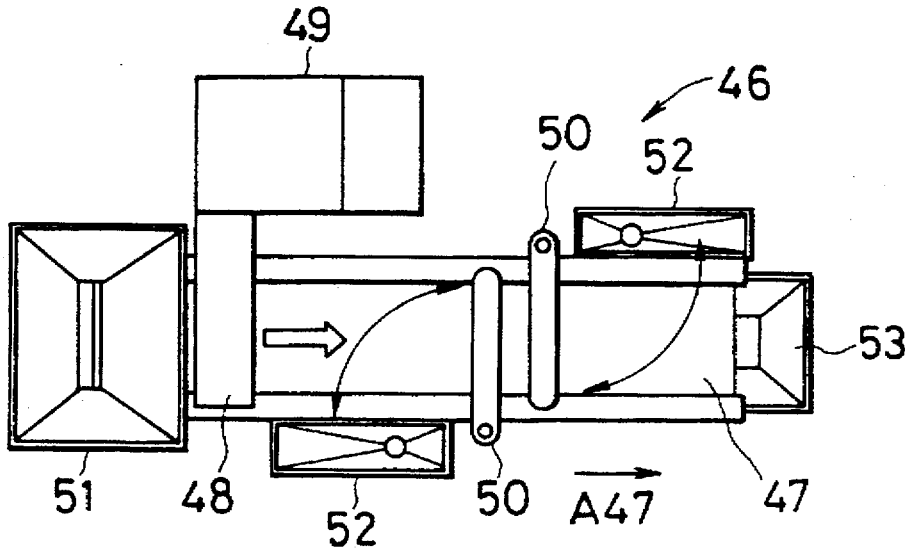
FIG. 7 is a plan view of an apparatus for inspecting substances contaminated with radioactivity.

Numeral 13 indicates a hot air generator, which comprises a heater 43 and a compressed air generator 44 and supplies hot air to the main vessel 18. Referring to FIG. 7, numeral 46 indicates an apparatus for inspecting substances contaminated with radioactivity, mainly used to inspect shot blast radioactivity and also available for inspection of other objects, for example, machine parts. Numeral 47 indicates a belt conveyor, which is made to intermittently run in the direction indicated by the arrow A47. Numeral 48 indicates a scintillation counter, which is formed as an elongated, band-like component extending perpendicular to the belt conveyor 47 so as to cover the entire width of the conveyor 47. The scintillation counter 48 is connected to a computerized control unit 49, which has a memory bank and is connected to a change-direction device 50 provided on the belt conveyor 47. Numeral 51 indicates a hopper. Numeral 52 indicates a defective-item receiver, and numeral 53 indicates a non-defective-item receiver. The shot blasting grit fed from the hopper 51 is intermittently moved in the direction of the arrow A47 by the belt conveyor 47, and is inspected for radioactivity, block by block each movement. A block in which radioactivity has been detected is memorized in the computerized control unit 49, and is removed by being changed in direction by the change-direction device 50 upon reaching the same. In this way, shot blasting grit free from radioactivity is collected.

The operation of the apparatus of this invention will now be described. First, grit contaminated with radioactivity and a polishing-cleaning material are fed into the decontamination vessel 22. An example of the polishing-cleaning material is a ceramic material. Then, the opening 20 is closed, and the opening 16 of the main vessel 18 is also closed. The decontamination vessel 22 is then rotated, and methylene chloride is ejected from the spray device 1, with the gas collecting device 14 being actuated. The grit is washed by the methylene chloride, and any radioactive paint or the like coexisting with the grit is removed therefrom, thereby decontaminating the grit. Such contaminated paint or the like is removed through filtration by the solvent filtering device 2.

Next, this methylene chloride is drained from the main vessel 18, and the grit is dried by hot air supplied from the hot air generator 13.

Subsequently, chelate liquid, supplied from the chelate liquid supply device 8, is ejected from the spray device 1, and the decontamination vessel 22 is rotated. The chelate liquid removes the radioactive metal ions in the grit, and is filtered by the chelate liquid filtering vessel before it returns to the chelate liquid vessel 37 to be circulated for decontamination. The chelate liquid is then electrolyzed by the electrolytic processing device 10 to thereby lose its chelating property. Then a precipitant is added to the chelate liquid, thereby forming flocs in the liquid. These flocs are removed by filtering the liquid by the filtering device 9. Then, the liquid is turned into clean water by the ion exchange device 39, supplied with fresh chelating agent from the chelating agent supply device 12 to be regenerated, and then returned to the chelate liquid supply device 8.

Part of the methylene chloride is transferred from the solvent vessel 31 to the solvent purifying device 6, where it is heated to be gasified and then cooled to be liquefied, whereby the methylene chloride is purified, and thereafter transferred to the rinse solvent vessel 34. Next, the chelate liquid is drained from the main vessel 18, and hot air is supplied from the hot air generator for drying of the grit. The temperature of this hot air is 70° C., which is much higher than the boiling point of methylene chloride. Accordingly, the temperature of the grit is raised to approximately 70° C. However, even after the above draining, some chelate liquid still remains in the grit, so that the drying process takes time and is difficultto perform.

In this condition, a rinse solvent consisting of methylene chloride is supplied. This rinse solvent is then rapidly vaporized, and, by the force of this vaporization, the remaining chelate liquid is separated from the grit. The liquid is then brought to the filtering device 2 by the subsequently fed rinse solvent, and is filtered by the filtering device 2 before it is recovered. The rinse solvent containing the chelate liquid is separated therefrom by an oil water separator 46, which effects separation through difference in specific weight, and is recovered in the solvent vessel 31. The grit in the main vessel 18 has been heated, so that the remaining methylene chloride is immediately vaporized to effect drying of the grit, with the result that the removal of the chelate liquid takes place quickly.

Advantages of the method of this invention will now be described. In the method of this invention, constructed as described above, the chelate liquid containing contaminated metal ions and remaining on the substance contaminated with radioactivity and adhering thereto, is separated from the contaminated substance by a rapid vaporization of the solvent, and then drained along with the subsequently supplied solvent, thereby effectively decontaminating the substance. Further, the draining of the solvent immediately results in a dried state, so that the bothersome operation of removing the remaining chelate liquid by drying process can be eliminated. This can be achieved very effectively when the solvent is methylene chloride. When the contaminated substance is shot blasting grit, which consists of fine particles, it is possible to quickly and effectively perform the difficult operations of separating and removing the remaining and adhering chelate liquid.

Next, advantages of the apparatus of this invention will be described. In the apparatus of this invention, constructed as described above, a single apparatus can perform all of the following processes: decontamination using a solvent, decontamination using a chelate liquid, rinsing using the solvent, in which rapid separation and removal of remaining chelate liquid is effected, drying of the grit, and so on.

The chelate liquid is electrolyzed by an electrolytic device, and in the precipitating device a precipitant is supplied to the chelate liquid which has lost its chelating property by the electrolysis, thereby forming flocs in the liquid. These flocs are removed by filtering the liquid by the filtering device. Then, the liquid is turned into clean water by the ion exchange device. By supplying some chelating agent to this clean water, the liquid can be recycled.

Thus, a single apparatus can perform all of the decontamination processes. Accordingly, the installation space for the apparatus can be reduced. Further, there is no need to provide complicated devices for moving the contaminated substance between a number of decontaminating apparatuses, nor is it necessary to perform the bothersome operation of moving the contaminated substance from one apparatus to another.

In addition, since the pores 19 of the decontamination vessel 22 have a size or width which is smaller than that of the grit, it is possible for the grit to be decontaminated effectively. Further, since the decontamination vessel 22 has a polishing-cleaning material, polishing and cleaning can be conducted simultaneously with the so-called running-liquid washing using the solvent and the chelate liquid, thereby conducting decontamination effectively.

Further, in an aspect of the invention where the decontamination vessel 22 is detachably formed with respect to the main vessel 18, and a plurality of main vessels 18 and a plurality of decontamination vessels 22 are formed, it is possible to separately conduct a process requiring a long time and thagt requiring a relatively short time, thereby achieving an improvement in operational efficiency.

What is claimed is:

1. An apparatus for decontaminating substances contaminated with radioactivity, comprising: a washing device including a spray device for ejecting liquid, a solvent filtering device, and a chelate liquid filtering device; a solvent supply device communicating with said spray device and said solvent filtering device and provided in such a way as to allow circulation of liquid; a rinse solvent supply device connected to said solvent supply device through the intermediation of a solvent purifying device; said rinse solvent supply device communicating with said spray device; a chelate liquid supply device provided in such a way as to allow circulation successively through said spray device andsaid chelate liquid filtering device; an electrolytic processing device communicting with said chelate liquid supply device and adapted to electrolyze the chelate liquid; a precipitation device which supplies a precipitant to the chelate liquid which has been electrolyzed by said electrolytic device and lost its chelating property, to form flocs in the chelate liquid; a filtering device communicating with an ion exchange device and adapted to remove said flocs by filtering; a chelating agent supply device communicating with said ion exchange device and adapted to supply a chelating agent to water; and a hot air supply device and a gas recovery device which communicate with said washing device.

2. An apparatus for decontaminating substances contaminated with radioactivity according to claim 1, wherein said washing device comprises a main vessel provided to a frame and having an opening and a lid; a decontamination vessel rotatably provided in said main vessel, having a multitude of pores in its outer periphery, and also having an opening and an opening/closing cover; and a driving device connected with said decontaminating vessel and adapted to rotate said decontaminating vessel.

3. An apparatus for decontaminating substances contaminated with radioactivity according to claim 2, wherein said pores have a width or size which is smaller than that of shot blasting grit, so that the shot blasting grit cannot pass said pores.

4. An apparatus for decontaminating substances contaminated with radioactivity according to claim 2 or 3, wherein said decontamination vessel has a polishing-cleaning material combined with said decontamination vessel.

5. An apparatus for decontaminating substances contaminated with radioactivity according to claim 2 or 3 wherein said decontamination vessel is formed to be detachable with respect to said main vessel, and wherein a plurality of said decontamination vessels and a plurality of said main vessels are formed.

* * * * *

UNITED STATES PATENT AND TRADEMARK OFFICE

CERTIFICATE OF CORRECTION

PATENT NO. : 5,666,984
DATED : September 16, 1997
INVENTOR(S) : HORIKAWA et al.

It is certified that error appears in the above-identified patent and that said Letters Patent is hereby corrected as shown below:

On the title page:

Item [75] is incorrect in that the name of one of the inventors is misspelled. Please change "Kenji Horikawa" to read --Kenji Morikawa-- therefor.

Signed and Sealed this

Twenty-eighth Day of April, 1998

Bruce Lehman

*Attest:*

BRUCE LEHMAN

*Commissioner of Patents and Trademarks*

*Attesting Officer*